US005974285A

United States Patent [19]

Tomatsu

[11] Patent Number: 5,974,285

[45] Date of Patent: Oct. 26, 1999

[54] FIXING UNIT THAT SUPPLIES ELECTRICITY TO A LAMP OF AN IMAGE FORMING APPARATUS IRRESPECTIVE OF EXPANSION AND CONTRACTION OF THE LAMP

[75] Inventor: Yoshiya Tomatsu, Kasugai, Japan

[73] Assignee: Brother Kogyo Kabushiki Kaisha, Nagoya, Japan

[21] Appl. No.: 09/027,211

[22] Filed: Feb. 20, 1998

[30] Foreign Application Priority Data

Feb. 27, 1997 [JP] Japan ..... 9-044120

[51] Int. Cl.[6] ..... G03G 15/00

[52] U.S. Cl. ..... 399/88; 219/216; 399/90; 399/330; 432/60

[58] Field of Search ..... 399/88, 90, 320, 399/328, 330; 219/216, 469; 432/60

[56] References Cited

U.S. PATENT DOCUMENTS 4,780,078 10/1988 Masui ..... 432/60

5,436,431 7/1995 Tsuji et al. ..... 219/216

5,737,664 4/1998 Fukuda et al. ..... 399/330 X

FOREIGN PATENT DOCUMENTS 9-319201 12/1997 Japan .

*Primary Examiner*—William Royer

*Attorney, Agent, or Firm*—Oliff & Berridge, PLC

[57] ABSTRACT

Even if a halogen lamp is thermally expanded or contracted when electricity is supplied to it, the fixing unit in accordance with the invention responds to the thermal expansion or contraction of the halogen lamp without breaking it and supplies electricity to the halogen lamp reliably. In the fixing unit, lead pins extend from both ends of the halogen lamp that is disposed in a heating roller. Each lead pin is fixed at a pin fixing portion wherein each lead pin is pinched by a top pinching portion and a bottom pinching portion of one of a pair of conductive spring members. A static friction force generated between each conductive spring member and the corresponding lead pin is set to not exceed 10 kgf, and the surface roughness of each lead pin is adjusted to not exceed Rz 3.2 $\mu$m. A cone-like pin guide portion which is open at the lead pin side is formed on the top pinching portion of the conductive spring member.

19 Claims, 6 Drawing Sheets

FIXING UNIT THAT SUPPLIES ELECTRICITY TO A LAMP OF AN IMAGE FORMING APPARATUS IRRESPECTIVE OF EXPANSION AND CONTRACTION OF THE LAMP

BACKGROUND OF THE INVENTION

1. Field of the Invention

The invention relates to a fixing unit of an image forming apparatus for heating a paper sheet. An image is formed on the paper sheet by supplying toner on an electrostatic latent image formed on a sensitive drum of a developing unit. The image is transferred with a heating roller to fix the toner image transferred to the paper sheet. Specifically, the invention relates to an inexpensive fixing unit which, even if a halogen lamp disposed in the heating roller is thermally expanded or contracted due to the supply of electricity to the halogen lamp, can respond flexibly to the thermal expansion or contraction without breaking the halogen lamp and supply the electricity reliably.

2. Description of Related Art

Various types of image forming apparatuses such as laser printers or similar devices that use electrophotography have been proposed. The specification and drawings of Japanese Published Patent Document No. 9-319201, for example, describes an image forming apparatus that generally includes a paper carrying unit, a laser scanning unit, a toner supply unit, a developing unit, a fixing unit and similar components. In such an image forming apparatus, an electrostatic latent image is formed on the surface of a sensitive drum in the developing unit according to image data. The electrostatic latent image is formed by the laser scanning unit. Toner is supplied to the sensitive drum according to the electrostatic latent image by the toner supply unit to form a toner image on the surface of the sensitive drum. The toner image is transferred to the paper sheet carried into the developing unit from the paper carrying unit by a transfer roller and the sensitive drum. The paper sheet subsequently is heated by the fixing unit to fix the toner image.

The fixing unit, in general, has a rotatable heating roller and a rotatable pressing roller which presses the heating roller. The toner image of the paper sheet is heated and fixed by the heating roller and the pressing roller. The heating roller is a rotatable roller. The rotatable roller is an aluminum cylinder, the surface of which is coated with Teflon resin. Moreover, a halogen lamp, which is used as a heating source, is fixed to the cover of the fixing unit and is disposed in the heating roller.

The halogen lamp includes a lamp, both ends of which are fixedly provided with electrodes coated with a coating material such as ceramic. The electrodes that are fixed at the both ends of the lamp are supplied with electricity by a harness connected thereto.

Typically, the halogen lamp that is used in the above-described fixing unit is expensive because the electrodes are previously fixed to both ends thereof and the electrodes are coated with a coating material such as ceramic. Therefore, providing an expensive halogen lamp as the heating source of the fixing unit increases the cost of the fixing unit and thus increases the total cost of the image forming apparatus.

Therefore, using a halogen lamp, whose both ends are not fixedly provided with electrodes and whose electrodes are not coated with a coating material, will reduce the cost of the fixing unit. In other words, using bare lead pins that extend from both ends of the halogen lamp will reduce costs.

However, when a halogen lamp, provided with bare lead pins extending from both ends thereof, is used as the heating source of the fixing unit, a problem arises regarding what structure is used for supplying electricity to the halogen lamp via each of the lead pins.

The halogen lamp is thermally expanded or contracted when it is turned on or off. The lead pins can be fixed with a large fixing force in contact with a conductive material that supplies electricity. However, if such a large fixing force is used, the pins are prevented from moving even if the halogen lamp expands or contracts due to temperature changes. As a result, the stress caused by the thermal expansion or contraction is applied to the joint portion of the lead pins and the lamp bulb to break the lamp bulb. However, if the fixing force between the lead pins and the conductive material is small, the lead pins move when the halogen lamp is thermally expanded or contracted. This movement prevents the lamp bulb from breaking. Electricity, however, may not be stably supplied to the halogen lamp via the conductive material, which prevents the toner image on the paper sheet from being reliably heated and fixed.

The inventor has made experiments and studies under these circumstances and has focused on a static friction force generated between the lead pins of the halogen lamp and the conductive material for supplying electricity. The invention is based on the static friction force which can flexibly move the lead pins when the halogen lamp is thermally expanded or contracted and can stably supply electricity to the lead pins.

SUMMARY OF THE INVENTION

It is therefore an object of the invention to solve the problems of conventional fixing units, and provide an inexpensive fixing unit which uses an inexpensive halogen lamp disposed in a heating roller and having lead pins extending from both ends thereof. The fixing unit can respond flexibly to the thermal expansion or contraction without breaking the halogen lamp and supply the electricity reliably, even if the halogen lamp is thermally expanded or contracted by electricity supplied to the halogen lamp.

In accordance with the above-described objects and according to one aspect of the invention, there is provided a fixing unit of an image forming apparatus for forming a toner image on a paper sheet and heating and fixing the toner image. The fixing unit includes a heating roller and a pressing roller that is pressed by the heating roller. The heating and pressing rollers are rotatably disposed in a cover. A halogen lamp is disposed in the heating roller and has lead pins extending from both ends thereof. A pair of electrode members are fixed to the cover such that they pinch each of the lead pins of the halogen lamp and supply electricity to the halogen lamp. A static friction force generated between the electrode member and the lead pin is set to not more than 10 kgf for at least one of the electrode members.

In the fixing unit described above, since each of the lead pins, extending from both ends of the halogen lamp disposed in the heating roller, is fixed to the cover such that each lead pin is pinched by a pair of electrode members that supply electricity, and a static friction force generated between at least one of the electrode members and the lead pin is set to not more than 10 kgf (kilogram force), as the halogen lamp is thermally expanded or contracted when the halogen lamp is turned on or off, the lead pin can hold an electric contact with the electrode member and can flexibly move with respect to the electrode member. Therefore, the invention provides an inexpensive fixing unit which responds flexibly to the thermal expansion or contraction of the halogen lamp without breaking the halogen lamp and can reliably supply electricity to the halogen lamp.

According to another aspect of the invention, the surface roughness of the above-described lead pin may be set to not more than Rz 3.2 $\mu$m. Since the surface roughness of the lead pin is set to not more than Rz 3.2 $\mu$m, the static friction force generated between the lead pin and the electrode member can be easily adjusted to not more than 10 kgf.

According to still another aspect of the invention, a cone-like pin guide portion which is open at its lead pin side may be formed in a pinching portion where the above-described electrode member pinches the lead pin. Since the cone-like pin guide portion which is open at its lead pin side is formed on the pinching portion where the above-described electrode member pinches the lead pin, when each lead pin is pinched by the electrode member, the lead pin can be easily pinched by the electrode member by only inserting the lead pin into the pin guide portion.

According to a further aspect of the invention, the above-described electrode member may include a conductive spring member that is elastic. Since the above-described electrode member is a conductive spring member that is elastic, the lead pin can hold an electric contact with the electrode member and can flexibly move because of the elastic force of the conductive spring member.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 1:
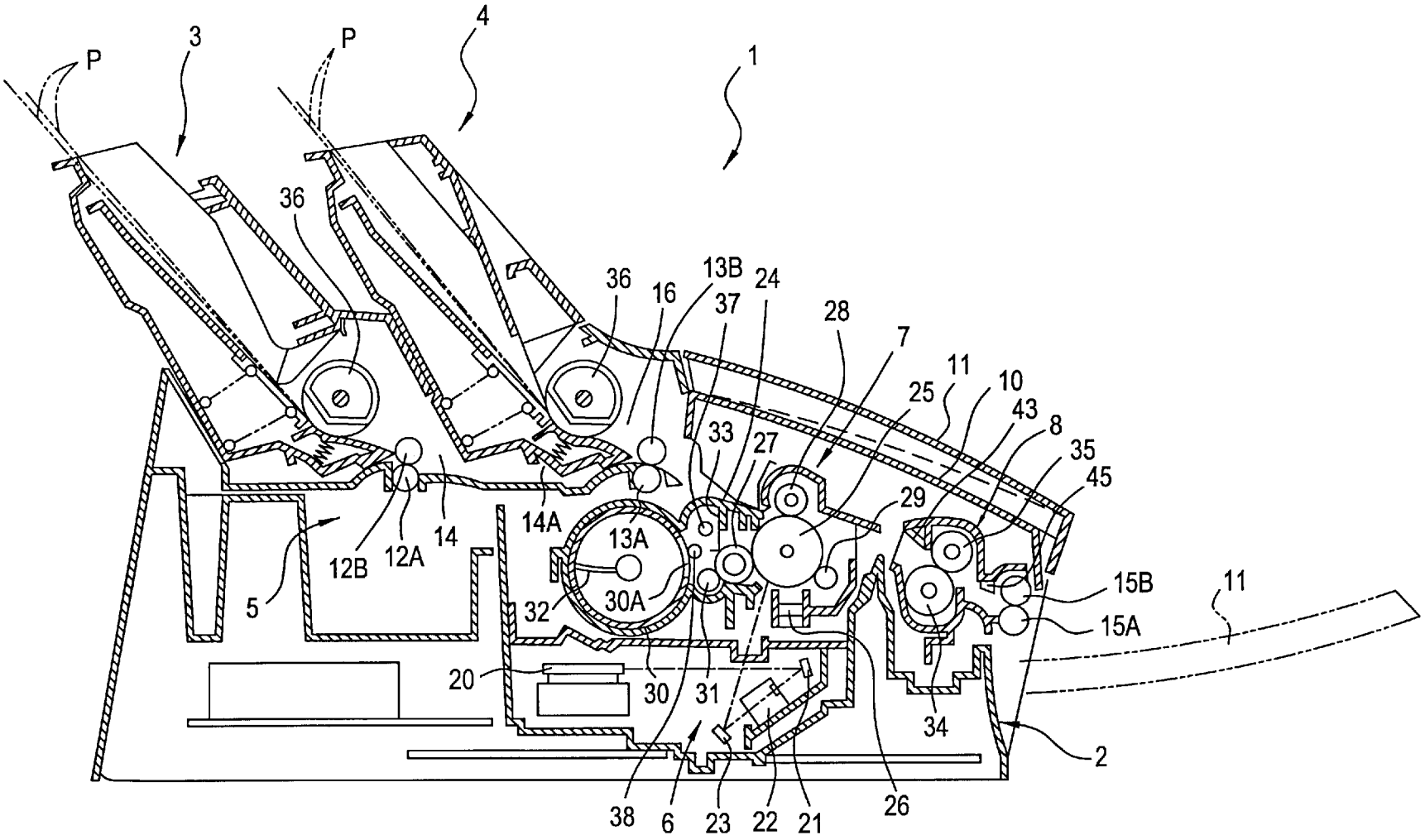
FIG. 1 is a side sectional view of a laser printer.

An image forming apparatus according to the invention will be hereinafter described in detail with reference to the drawings based on a laser printer in which the invention is embodied. First, the structure of the laser printer relating to the embodiment will be described with reference to FIG. 1. FIG. 1 is a side sectional view of a laser printer.

In FIG. 1, the laser printer 1 has a body case 2, a first paper supply tray 3 mounted on a top surface side of a rear portion of the body case 2, a second paper supply tray 4, a paper sheet carrying mechanism 5 mounted in the body case 2, a scanner unit 6, a processing unit 7, a fixing unit 8, and a drive unit (not shown; received in the left end side portion of the body case 2) for driving the first and second paper supply trays 3 and 4, the paper sheet carrying mechanism 5, and similar mechanisms. A top cover 10 which can open the top surface side of a printing mechanism portion and a paper discharge tray 11 are provided on the top surface side of the front portion of the body case 2. The paper discharge tray 11 can be freely changed between a closed position and an open position. The paper discharge tray 11 operates as a tray which receives a printed paper sheet at the open position.

The scanner unit 6, the processing unit 7, and the fixing unit 8 correspond to a printing mechanism portion. The processing unit 7 includes a casing 24. A sensitive drum 25, a charging unit 26, a developing roller 27, a transfer roller 28, a cleaning roller 29 and similar devices are disposed in the casing 24. A cartridge structure can be removably attached to a specified position in the body case 2.

The first paper supply tray 3 is fixedly mounted on the top surface of the portion near the rear end of the body case 2. The second paper supply tray 4 is removably mounted on the top surface of the front side of the first paper supply tray 3 in the body case 2. The above-described paper sheet carrying mechanism 5 carries the paper sheet P supplied selectively from the first paper supply tray 3 or the second paper supply tray 4 to the processing unit 7. The paper sheet carrying mechanism 5 has a pair of feed rollers 12A and 12B which are mounted on the bottom end side of the first paper supply tray 3 and a pair of resist rollers 13A and 13B which are mounted on the bottom end side of the second paper supply tray 4. Feed roller 12A is a drive roller and feed roller 12B is a driven roller. The resist roller 13A is a drive roller and the resist roller 13B is a driven roller. A paper sheet carrying path 14 from the first paper supply tray 3 to the resist rollers 13A and 13B includes a bottom surface side carrying path 14A. The bottom surface side carrying path 14A extends along the bottom surface of the second paper supply tray 4 and is open to the exterior of the device when the second paper supply tray 4 is removed from the body case 2.

The paper sheet P supplied from the first paper supply tray 3 via a pickup roller 36 is driven and carried by the pair of feed rollers 12A and 12B to the resist rollers 13A and 13B through the bottom surface side carrying path 14A. The paper sheet P is resisted and then is driven and carried to the processing unit 7. The paper sheet P supplied from the second paper supply tray 4 via the pickup roller 36 is carried to the pair of resist rollers 13A and 13B. The paper sheet P is resisted and then is driven and carried to the processing unit 7.

The scanner unit 6 is disposed under the processing unit 7 and has a semiconductor laser (not shown), a polygon mirror 20, reflection mirrors 21 and 23, and a lens 22. A laser beam from the semiconductor laser is applied by high speed scanning to the outer peripheral portion of the sensitive drum 25 of the processing unit 7, which is charged and rotating, as shown by a chain line. The laser beam is applied via the polygon mirror 20, the reflection mirror 21, the lens 22, and the reflection mirror 23, whereby an electrostatic latent image is formed on the surface of the sensitive drum 25 exposed to the laser beam.

As discussed above, the processing unit 7 houses the sensitive drum 25, the scorotron-type charging unit 26, the developing roller 27, the transfer roller 28, the cleaning roller 29, a toner box 30, and a toner supply roller 31 in the casing 24. The toner box 30 is removably disposed in the processing unit 7 and can be replaced when the processing unit 7 is removed from the body case 2. The toner in the toner box 30 is stirred by a stirring member 32 and is discharged from an opening 30A of the toner box 30. The discharged toner is supplied to the developing roller 27 via a toner supply roller 31 and is formed into a toner layer of a specified thickness, by a blade 33, on the developing roller 27. Moreover, two auger members 37 and 38 are arranged near the opening 3C of the toner box 30. Each of the auger members 37 and 38 uniformly disperses the toner discharged from the opening 30A in the casing 24.

The electrostatic latent image formed on the surface of the sensitive drum 25 forms a visible image by sticking the toner from the developing roller 27 thereto. The image is transferred to the paper sheet while the paper sheet is passed between the sensitive roller 25 and the transfer roller 28. The paper sheet is sent into the fixing unit 8 to fix the image thereto. Moreover, the toner remaining on the surface of the sensitive drum 25 is temporarily collected by the cleaning roller 29, and then is collected by the developing roller 27 via the sensitive roller 25 at a specified timing.

The fixing unit 8 thermally fixes the toner on the paper sheet and has a heating roller 34, a pressing roller 35 that is pressed toward the heating roller 34, and a pair of discharge rollers 15A and 15B. The discharge rollers are mounted in the downstream side of the rollers 34 and 35 and discharge the paper sheet to the outside of the body case 2.

In addition, the carrying speed at which the paper sheet P exits the sensitive roller 25 and the transfer roller 28 of the processing unit 7 is set to be equal to or faster than the carrying speed at which the paper sheet P exits the heating roller 34, the pressing roller 35 and discharging rollers 15A and 15B of the fixing unit 8. This is because, if the carrying speed at which the paper sheet P exits the heating roller 34, the pressing roller 35 and discharge rollers 15A and 15B is faster than the carrying speed at which the paper sheet P exits the sensitive roller 25 and the transfer roller 28, the paper sheet P is pulled at a nip point between the sensitive drum 25 and the transfer roller 28 where the toner image is transferred to the paper sheet P from the sensitive drum 25. This causes a displacement in the position of the image formed on the paper sheet P, which may produce a disturbed image.

Figure 2:
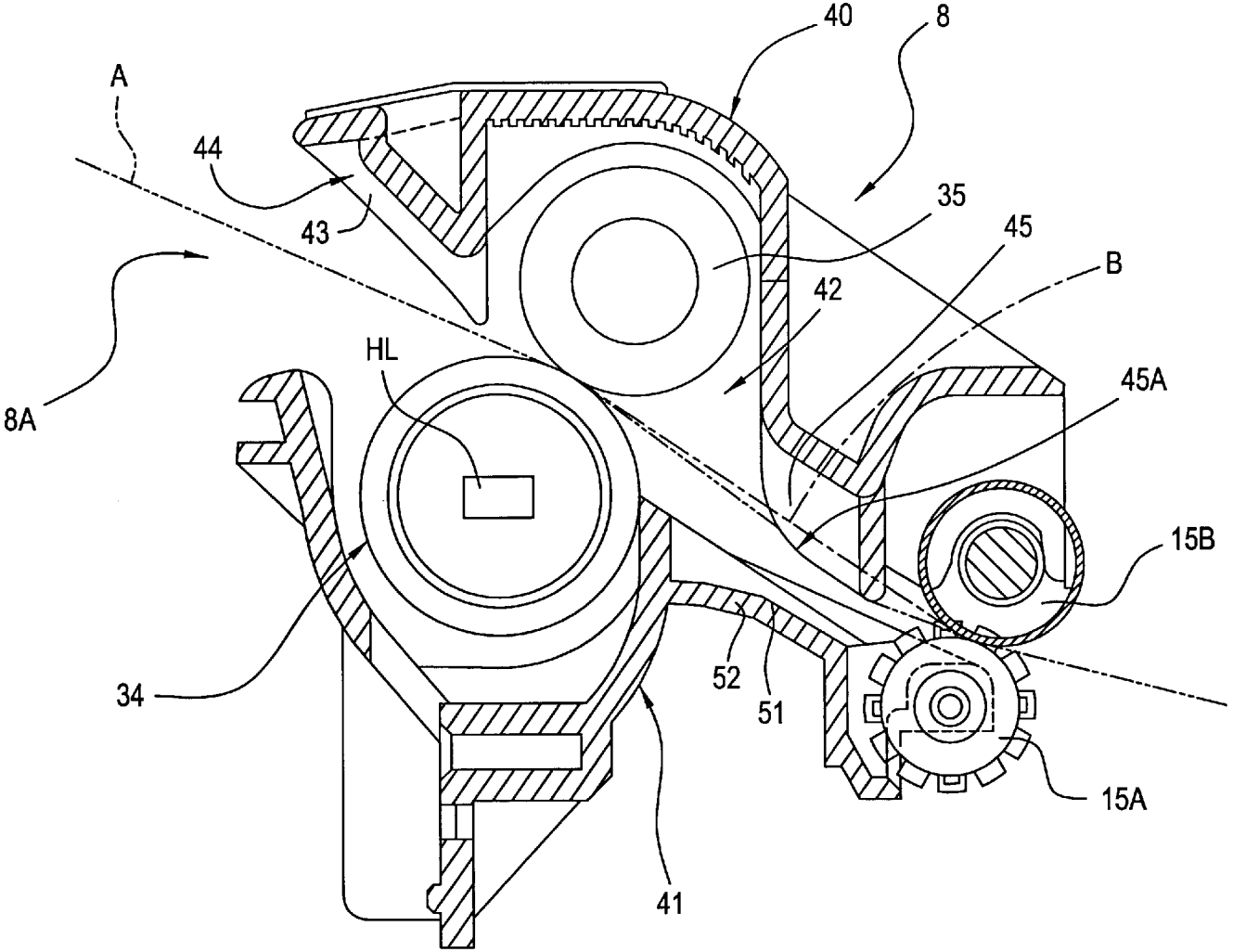
FIG. 2 is a side sectional view, on an enlarged scale, of a fixing unit.

Next, the structure of the fixing unit 8 will be described in detail based on FIG. 2. FIG. 2 is a side sectional view, on an enlarged scale, of the fixing unit 8.

The fixing unit 8 has a top cover 40, a bottom cover 41, and a fixing chamber 42 that is defined by the top cover 40 and the bottom cover 41. In the fixing chamber 42, a heating roller 34 is rotatably disposed in the lower side thereof, and a pressing roller 35 that is pressed toward the heating roller 34 is rotatably disposed in the upper side thereof. The heating roller 34 is provided with a halogen lamp HL which acts as a heating source and is fixed to the bottom cover 41 of the fixing unit 8. The halogen lamp HL is disposed in the rotatable roller body, which includes a cylinder made of aluminum or similar material, the surface of which is coated with Teflon resin. The structure of the above-described heating roller 34 is known and the description thereof will be omitted here. The apparatus for fixing the halogen lamp HL to the bottom cover 41, however, will be described below.

A plurality of guide ribs 43 extend in a direction orthogonal to the carrying path A of the paper sheet P (shown by a chain double-dashed line), i.e., in the direction of the length of the pressing roller 35 and the heating roller 34 at the top end side of the top cover 40 (the left end side in FIG. 2) in the upstream side of the fixing chamber 42. The guide ribs 43 smoothly guide, into the fixing chamber 42, the paper sheet P that exits the processing unit 7 and enters through the paper introduction port 8A. The guide rib 43 has a slant surface 44 that gradually slants downward along the carrying path A of the paper sheet P. The top end of the paper sheet P initially contacts the slant surface 44 of the guide rib 43 and then is guided downward along the slant surface 44. The paper sheet P is sent out to a nip point between the pressing roller 35 and the heating roller 34.

Moreover, an anti-curl rib 45 is formed on the inner upper wall of the top cover 40 in the downstream side of the pressing roller 35 and the heating roller 34. The anti-curl rib 45 eliminates the curl produced on the paper sheet P when the toner image on the paper sheet P is heated and fixed by the heating roller 34 and the pressing roller 35. Further, a pair of paper discharge rollers 15A and 15B, for discharging the paper sheet P to the exterior of the device after the toner image is heated and fixed are rotatably disposed in the downstream side of the fixing chamber 42.

The anti-curl rib 45 protrudes from the inner upper wall of the top cover 40 such that it crosses a straight line B (shown by a chain line) connecting a contact point of the heating roller 34 and the pressing roller 35 to a contact point of the paper discharge rollers 15A and 15B, whereby the bottom end of the anti-curl rib 45 is disposed below the straight line B. Thus, the anti-curl rib 45 presses the paper sheet P downward, which eliminates the curl produced on the paper sheet P when the paper sheet P is heated and fixed by the heating roller 34 and the pressing roller 35. Moreover, the anti-curl rib 45 has a curved surface 45A at the portion opposite to the heating roller 34 and the pressing roller 35. The curved surface 45A guides the top end of the paper sheet P sent by the heating roller 34 and the pressing roller 35 downward to smoothly change the direction of the paper sheet P toward the paper discharge rollers 15A and 15B. The paper sheet P is thereby passed along the paper carrying path A and the curl is eliminated easily.

Figure 3:
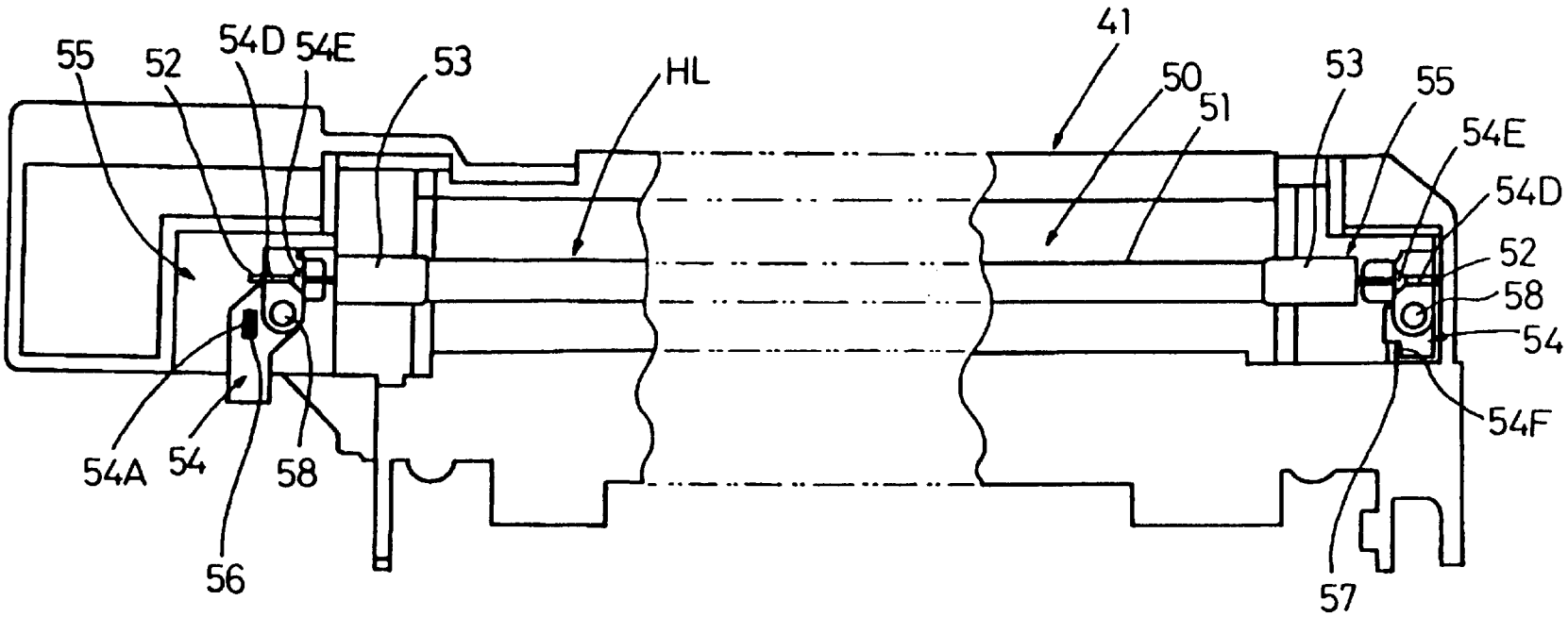
FIG. 3 is a partial plan view showing a mounting of a halogen lamp.
Figure 4:
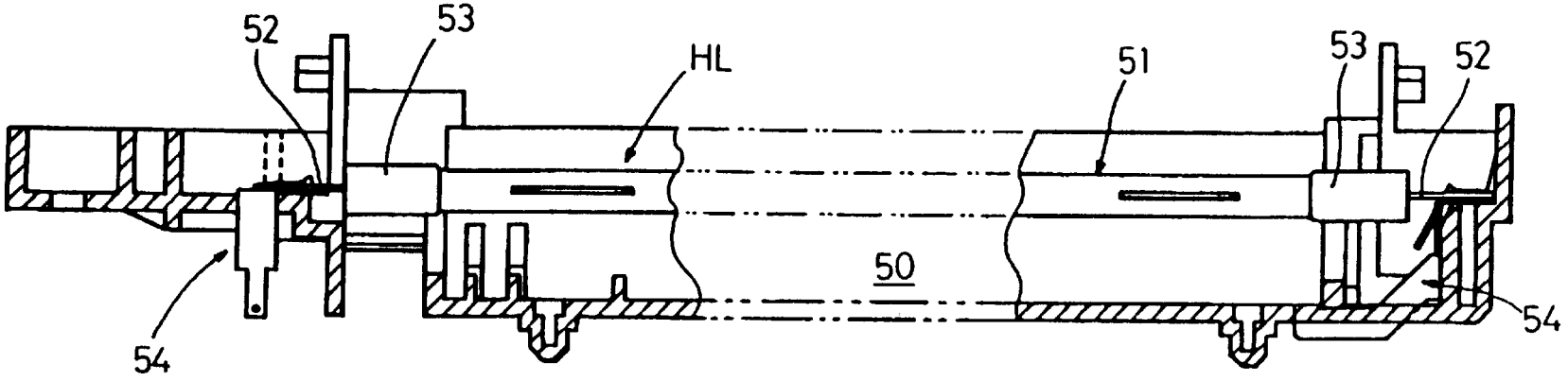
FIG. 4 is a partial side sectional view showing a mounting of a halogen lamp.
Figure 5:
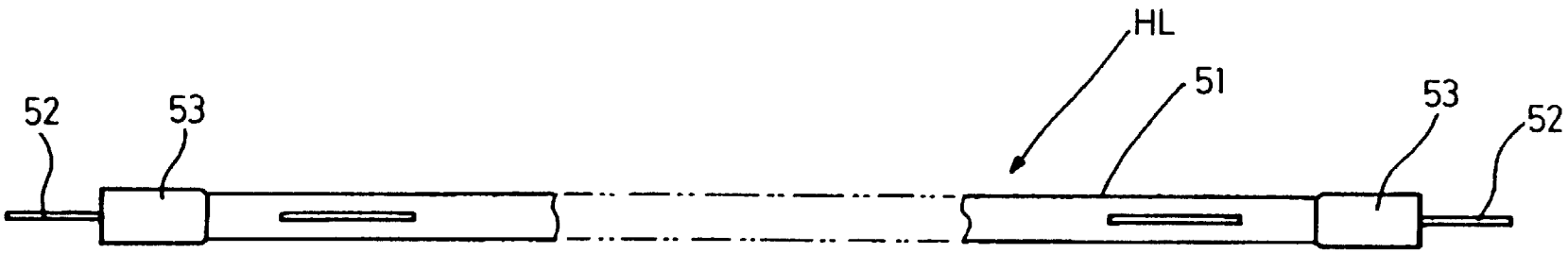
FIG. 5 is a partial plan view of a halogen lamp.
Figure 6:
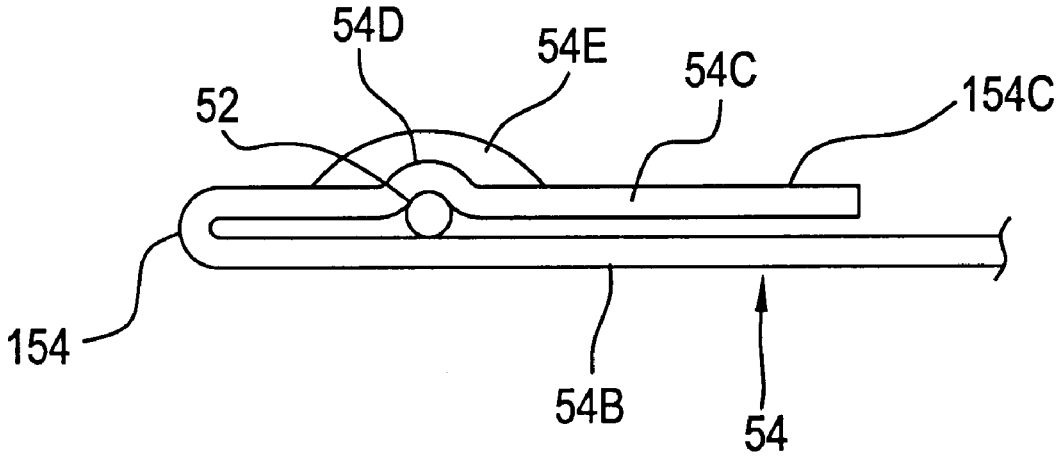
FIG. 6 is a partial schematic showing a lead pin of a halogen lamp which is pinched by a conductive spring member.

Next, an apparatus for fixing the halogen lamp HL to the bottom cover 41 will be described based on FIGS. 3–6. FIG. 3 is a partial view of the bottom cover 41 showing a mounting of a halogen lamp HL. FIG. 4 is a partial side sectional view of the bottom cover 41 showing a mounting of a halogen lamp HL. FIG. 5 is a partial plan view of a halogen lamp HL. FIG. 6 is a partial schematic showing a lead pin of the halogen lamp HL which is pinched by a conductive spring member (electrode member).

In FIGS. 3 and 4, the bottom cover 41 has a lamp disposing portion 50. The halogen lamp HL is disposed in the lamp disposing portion 50. The halogen lamp HL, as shown in FIG. 5, includes a lamp bulb 51 made of glass, lead pins 52 extending from both ends of the lamp bulb 51 and fixing parts 53 for fixing the lead pins 52 at both ends of the lamp bulb 51. Moreover, the surface roughness of the lead pins 52 is adjusted to not more than Rz 3.2 $\mu$m (mean roughness of ten points). This is because, if the surface roughness of the lead pins 52 is greater than Rz 3.2 $\mu$m, when a conductive spring member 54 (electrode member) is fixed to the lead pin fixing part 55 by a bolt 58, and the lead pin 52 is pinched by the conductive spring member 54, it is difficult to control a static friction force of more than 10 kgf that is generated between the lead pin 52 and the conductive spring member 54 due to the fastening force of the bolt 58. If the static friction force between the lead pin 52 and the conductive spring member 54 exceeds 10 kgf, when the halogen lamp HL is turned on or off and thus is thermally expanded or contracted, the lead pin 52 cannot move and the lamp bulb 51 breaks. This phenomenon was checked by experiment.

Further, pin fixing parts 55 are disposed on both sides of the lamp disposing portion 50 in the bottom cover 41. Each of the lead pins 52 of the halogen lamp HL is fixed at each of the pin fixing parts 55 by being pinched by the conductive spring member 54. Each of the conductive spring members 54 disposed at each pin fixing part 55 is formed of pressed conductive metal plate, such as copper, and has the same structure.

A positioning hole 54A is defined in the conductive spring member 54 disposed at the left side pin fixing part 55 as shown in FIGS. 3 and 4. A positioning projection 56 made on the bottom cover 41 is fitted in the positioning hole 54A to position the conductive spring member 54 at the pin fixing part 55.

Further, as shown in FIG. 6, the conductive spring member 54 has a bottom pinching portion 54B and a top pinching portion 54C which are integrally formed such that they pinch the lead pin 52. Specifically, the bottom pinching portion 54B is connected to the top pinching portion 54C via a curved portion 154. Furthermore, the top pinching portion 54C has a straight portion 154C that extends substantially parallel to the bottom pinching portion 54B, an arc portion 54D which matches the curvature of the lead pin 52 and a cone-like pin guide portion 54E which is open at the lead pin 52 side (inner side in FIGS. 3 and 4). The lead pin 52 can easily be pinched between the bottom pinching portion 54B and the top pinching portion 54C of the conductive spring member 54 by inserting the lead pin 52 into the pin guide portion 54E.

Moreover, the conductive spring member 54 disposed at the right side pin fixing part 55, as shown in FIGS. 3 and 4, has a positioning groove 54F. The positioning groove 54F is retained by a positioning projection 57 formed on the bottom cover 41 to position the conductive spring member 54 at the pin fixing part 55. The right side conductive spring member 54 is otherwise the same as the left side conductive spring member 54. Further, the end of the lead pin 52 at the right side pin fixing part 55 contacts the wall surface of the pin fixing part 55.

Each of conductive spring members 54 is fastened and fixed to each pin fixing part 55 via the bolt 58 such that the bottom pinching portion 54B and the top pinching portion 54C thereof pinch the lead pin 52. The static friction force generated between the bottom pinching portion 54B, the top pinching portion 54C and the lead pin 52 is set to not exceed 10 kgf, as described above, because the surface roughness of the lead pin 52 is adjusted to not exceed Rz 3.2 $\mu$m. Since the static friction force is set to not exceed 10 kgf, as the lead pin 52 is thermally expanded or contracted when the halogen lamp HL is turned on or off, the lead pin 52 remains electrically connected with the conductive spring member 54 and can move flexibly relative to the conductive spring member 54. Thus, the lead pin 52 can respond flexibly to the thermal expansion or contraction without breaking the halogen lamp HL, and can reliably supply electricity to the halogen lamp HL.

Moreover, each conductive spring member 54 is connected to an electric power source (not shown) and electricity is supplied to the halogen lamp HL by the electric power source. In the above-described embodiment, the end portion of the right side lead pin 52 contacts the wall surface of the pin fixing part 55, and thus does not move when the halogen lamp HL is thermally expanded or contracted. Only the lead pin 52 at the left side pin fixing part 55 can move. Of course, if the right side lead pin 52 is separated from the wall surface of the pin fixing part 55, both lead pins 52 can move.

As described above in detail, in the fixing unit 8 of the laser printer 1 according to the present embodiment. The lead pins 52 extend from both ends of the halogen lamp HL that is disposed in the heating roller 34. The lead pins 52 are fixed to the pin fixing parts 55 such that each lead pin 52 is pinched by the bottom pinching portion 54B and the top pinching portion 54C of each conductive spring member 54 at each pin fixing portion 55. The static friction force generated between the conductive spring member 54 and the lead pin 52 is set to not exceed 10 kgf. Thus, as the halogen lamp HL is thermally expanded or contracted as it is turned on or off, the lead pin 52 can maintain an electric contact with the conductive spring member 54 and can flexibly move with respect to the conductive spring member 54. Therefore, an inexpensive fixing unit 8 is provided which responds flexibly to the thermal expansion or contraction of the halogen lamp HL without breaking it and which can reliably supply electricity to the halogen lamp HL.

Further, since the surface roughness of each lead pin 52 is adjusted to not exceed Rz 3.2 $\mu$m, the static friction force generated between the lead pin 52 and the conductive spring member 54 can be easily adjusted to not exceed 10 kgf.

Still further, the cone-like pin guide portion 54E, which is open at the lead pin 52 side, is formed on the top pinching portion 54C of the conductive spring member 54. Thus, each lead pin 52 can be easily pinched by the conductive spring member 54 by only inserting it into the pin guide portion 54E.

Furthermore, each lead pin 52 is pinched by conductive spring member 54. Thus, the elastic force of the conductive spring member 54 enables the lead pin 52 to move flexibly and maintain electric contact with the conductive spring member 54.

In addition, while the invention has been described in conjunction with a preferred embodiment thereof, it will be understood that it is not intended to limit the invention to the embodiment described above. On the contrary, it is intended to cover all such alternatives, modifications and variations that fall within the spirit and scope of the invention as defined by the appended claims.

For example, although the fixing unit 8 which heats and fixes the toner image formed on the paper sheet P by the sensitive drum 25 and the transfer roller 28 has been described as a preferred embodiment, it is not intended to limit the invention to the embodiment. It is evident, for example, that the invention can also be applied to an image forming apparatus which injects directly the toner on the paper sheet to form the toner image.

What is claimed is:

1. A fixing unit for use with an image forming apparatus that forms a toner image on a sheet of paper, heats the toner image and fixes the toner image on the sheet of paper, the fixing unit comprising:

one cover;

an other cover, the one cover and the other cover defining a fixing chamber;

a heating roller rotatably disposed in the fixing chamber;

a pressing roller rotatably disposed in the fixing chamber, the pressing roller being pressed toward the heating roller;

a heating source disposed in the heating roller;

a first lead pin extending from a side of the heating source and a second lead pin extending from another side of the heating source; and a pair of electrode members fixed to one of the one cover and the other cover, one of the pair of electrode members pinching the first lead pin and the other of the pair of electrode members pinching the second lead pin, the electrode members supplying electricity to the heating source;

wherein a static friction force generated between the one of the pair of electrode members and the first lead pin does not exceed 10 kgf.

2. The fixing unit as claimed in claim 1, wherein the surface roughness of the first lead pin does not exceed Rz 3.2 μm.

3. The fixing unit as claimed in claim 1, further including a cone-like pin guide portion having an open end adjacent to the first lead pin and disposed at the one of the pair of electrode members.

4. The fixing unit as claimed in claim 1, wherein the one of the pair of electrode members includes an elastic conductive spring member.

5. The fixing unit as claimed in claim 4, wherein the one of the pair of electrode members includes a top pinching portion and a bottom pinching portion, the first lead pin disposed between the top pinching portion and the bottom pinching portion.

6. The fixing unit as claimed in claim 5, wherein the top pinching portion includes an arc portion, the arc portion contacting the first lead pin.

7. The fixing unit as claimed in claim 6, wherein the top pinching portion includes a straight portion, the straight portion extending substantially parallel to the bottom pinching portion.

8. The fixing unit as claimed in claim 7, wherein the top pinching portion and the bottom pinching portion are connected by a curved portion.

9. The fixing unit as claimed in claim 8, wherein a length of the bottom pinching portion is greater than a length of the top pinching portion.

10. The fixing unit as claimed in claim 1, further including a pair of bolts, wherein each of the pair of electrode members is fixed to the one of the one cover and the other cover by one of the pair of bolts.

11. The fixing unit as claimed in claim 1, further including a first positioning projection projecting from the one of the one cover and the other cover, and wherein the one of the pair of electrode members defines a positioning hole, such that the first positioning projection projects through the positioning hole when the one of the pair of electrode members is fixed to the one of the one cover and the other cover in the proper position.

12. The fixing unit as claimed in claim 1, further including a second positioning projection projecting from the one of the one cover and the other cover, and wherein the other of the pair of electrode members defines a positioning groove, such that the second positioning projection communicates with the positioning groove when the other of the pair of electrode members is fixed to the one of the one cover and the other cover in the proper position.

13. A method of supplying electricity to a heating source of a fixing unit of an image forming apparatus that forms a toner image on a sheet of paper, heats the toner image and fixes the toner image on the sheet of paper, the heating source being disposed in a heating roller of the fixing unit, and having a first lead pin extending from a side of the heating source and a second lead pin extending from another side of the heating source, the method comprising the steps of:

pinching the first lead pin with one of a pair of electrode members that are fixed to a cover of the fixing unit; and pinching the second lead pin with the other of the pair of electrode members;

wherein a static friction force generated between the one of the pair of electrode members and the first lead pin does not exceed 10 kgf.

14. The method as claimed in claim 13, wherein the surface roughness of the first lead pin does not exceed Rz 3.2 μm.

15. The method as claimed in claim 13, wherein the step of pinching the first lead pin includes pinching the first lead pin between top and bottom portions of the one of the pair of electrode members.

16. The method as claimed in claim 15, wherein the step of pinching the first lead pin includes contacting the first lead pin with an arc portion of the top pinching portion.

17. The method as claimed in claim 13, further including the step of fixing each of the pair of electrode members to the cover with one of a pair of bolts.

18. The method as claimed in claim 13, further including the step of extending a first projection of the cover through a positioning hole defined in the one of the pair of electrode members.

19. The method as claimed in claim 13, further including the step of communicating a second projection of the cover with a positioning groove defined in the other of the pair of electrode members.

* * * * *